US005176021A

United States Patent [19]

Jensen et al.

[11] Patent Number: 5,176,021

[45] Date of Patent: Jan. 5, 1993

[54] METHOD AND APPARATUS FOR MAKING SHAPED METAL PARTS BY FORMING SHEET METAL

[75] Inventors: Niels D. Jensen; Soren Simonsen, both of Bjerringbro, Denmark

[73] Assignee: Grundfos International a/s, Bjerringbro, Denmark

[21] Appl. No.: 867,286

[22] Filed: Apr. 9, 1992

Related U.S. Application Data

[63] Continuation of Ser. No. 595,107, Oct. 10, 1990, abandoned.

[30] Foreign Application Priority Data

Oct. 26, 1989 [DE] Fed. Rep. of Germany ..... 3935666

[51] Int. Cl.[5] ..... B21D 22/00

[52] U.S. Cl. ..... 72/348; 72/350; 72/351

[58] Field of Search ..... 72/348, 347, 350, 351, 72/379.4, 105, 106, 117, 126

[56] References Cited

U.S. PATENT DOCUMENTS

| | | | |
|---|---|---|---|
| 2,072,847 | 3/1937 | Bolesky | 72/333 |
| 2,828,493 | 4/1958 | Koehler | 72/126 |
| 3,496,896 | 2/1970 | Smith | 72/348 |
| 3,543,559 | 12/1970 | Hawkins et al. | 72/348 |
| 3,695,201 | 10/1972 | Frankenberg | 72/348 |
| 4,245,489 | 1/1981 | Estes et al. | 72/126 |
| 4,365,498 | 12/1982 | Hirota et al. | 72/351 |
| 4,397,171 | 8/1983 | Suh et al. | 72/348 |

FOREIGN PATENT DOCUMENTS

| | | | |
|---|---|---|---|
| 2225466 | 1/1973 | Fed. Rep. of Germany . | |
| 0282730 | 12/1987 | Japan | 72/348 |
| 0015233 | 1/1989 | Japan | 72/348 |
| 0179359 | 5/1962 | Switzerland | 72/91 |

*Primary Examiner*—Lowell A. Larson
*Assistant Examiner*—Michael J. McKeon
*Attorney, Agent, or Firm*—Dvorak and Traub

[57] ABSTRACT

In the method proposed a peripheral wall with at least one axial section of high shaping and fitting accuracy is made by forming an initial blank. This accuracy is achieved, in that before the peripheral wall is formed, sheet material which has been put into a plastic state is swaged in places round the periphery, then the swaged locations are sized, and/or in that during or after the formation of the peripheral wall, the wall is shaped by stamping in a plurality of places along its periphery, whereby the said zone providing shaping and fitting accuracy is formed from fitting areas at at least one side of the peripheral wall in the region of the swaged and/or stamped locations. An apparatus for carrying out such a method is generally in the form of a drawing machine, wherein the holder and/or the bottom die contain radial apertures, which open into the inner edge of the holder and/or into the shaping cavity of the die, and which are arranged at intervals round the periphery. The wall surfaces of the upper die and/or of the shaping cavity act as sizing surfaces to form fitting areas in swaged locations on the peripheral wall of the shaped part, the swaged locations being formed by said apertures.

9 Claims, 9 Drawing Sheets

FIG. 4
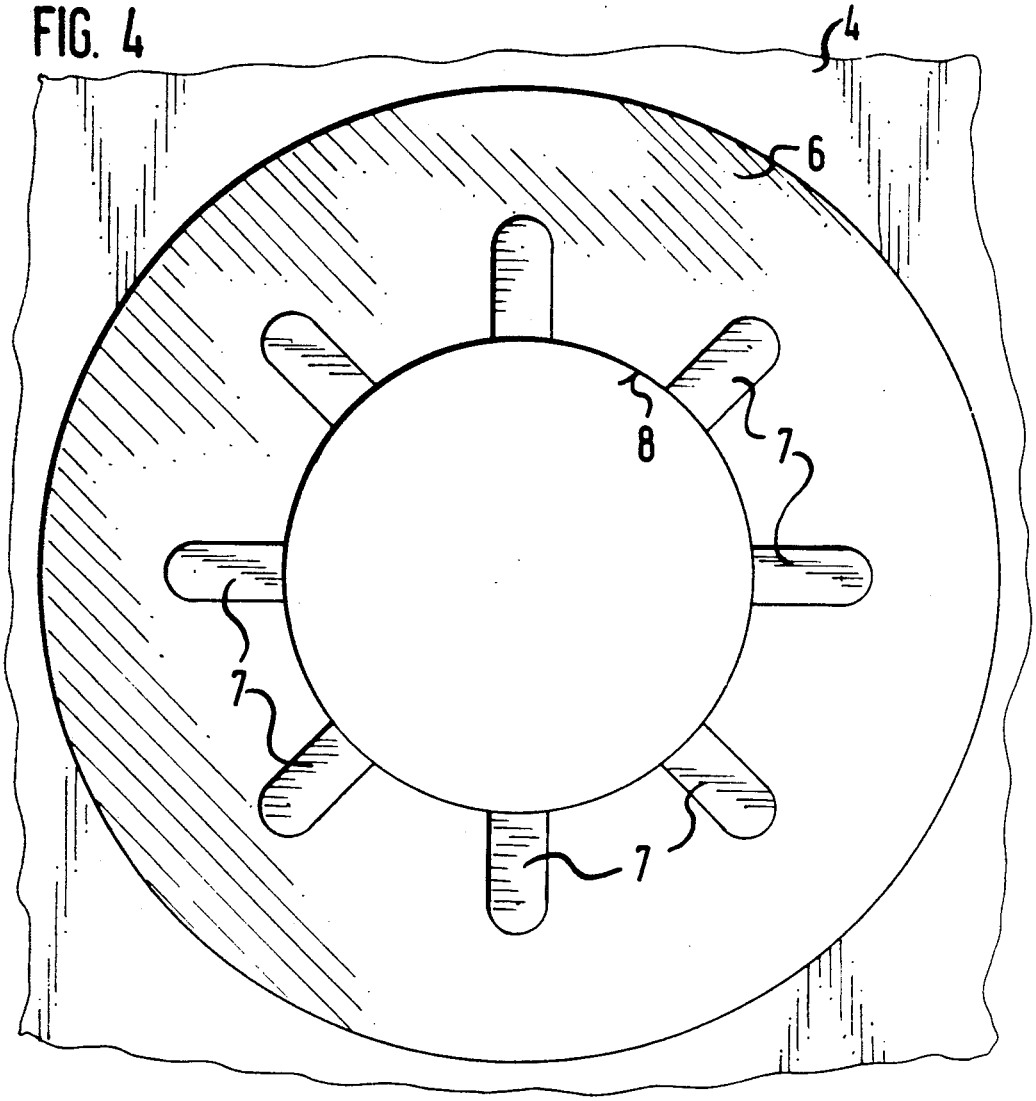
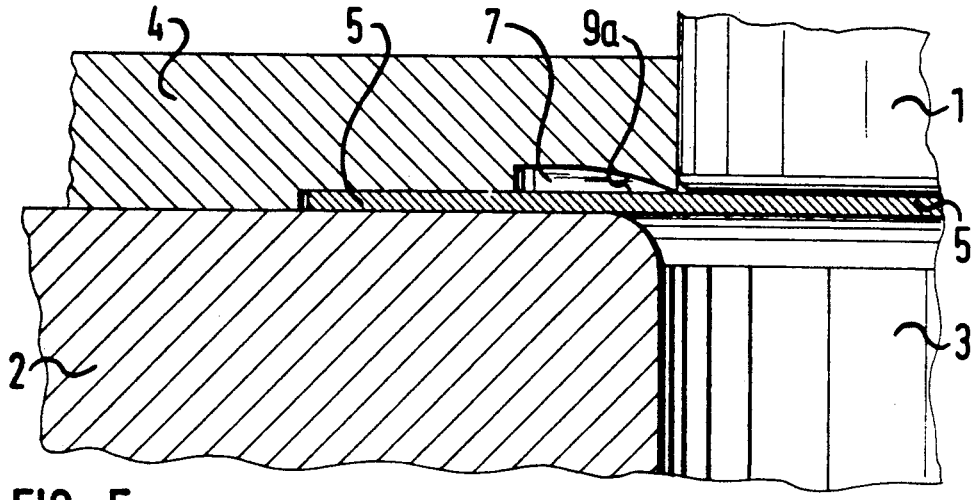
FIG. 5

FIG. 8
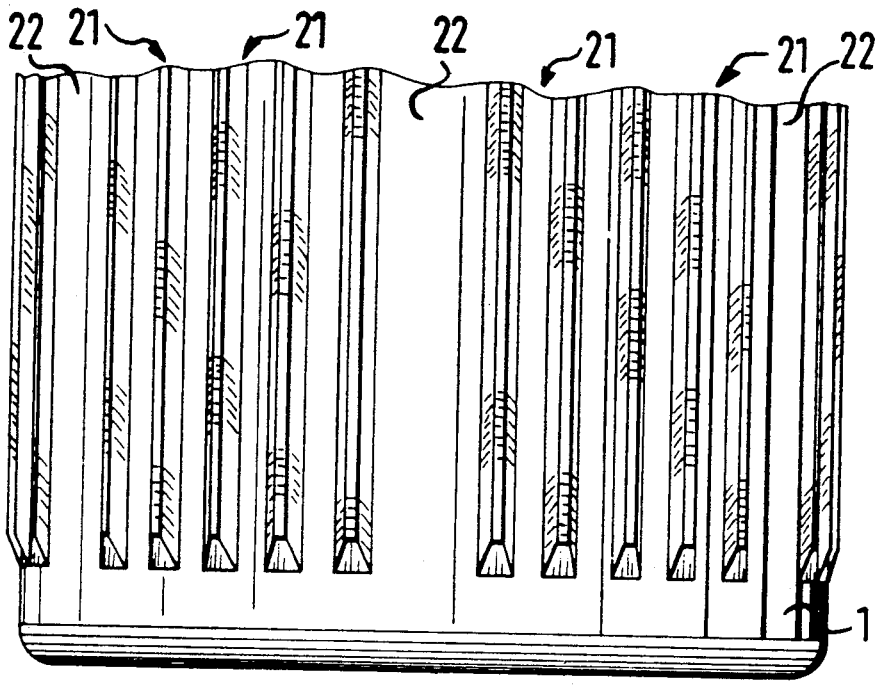
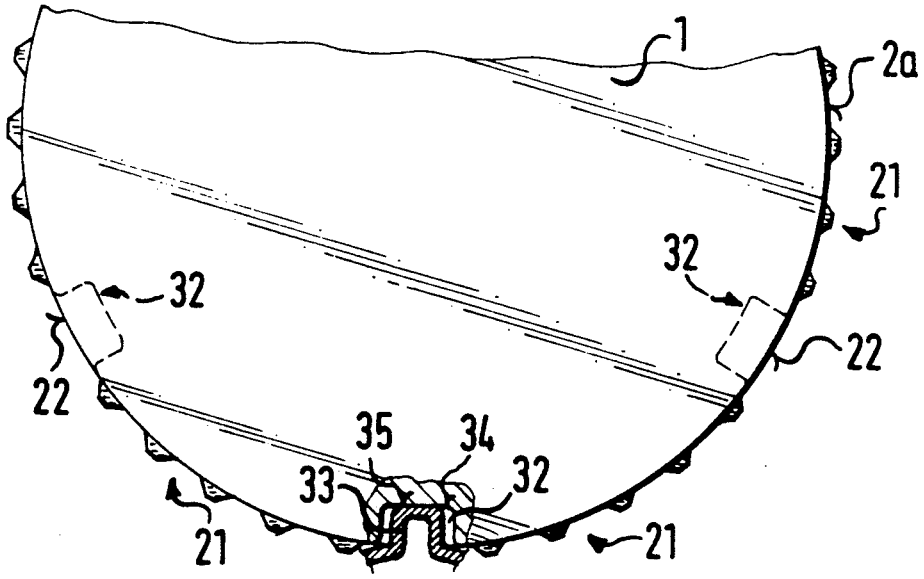
FIG. 9

METHOD AND APPARATUS FOR MAKING SHAPED METAL PARTS BY FORMING SHEET METAL

This application is a continuation of application Ser. No. 07/595 107 filed Oct. 10, 1990, now abandoned.

FIELD OF THE INVENTION

The invention relates to a method of making shaped metal parts by forming sheet metal, wherein an initial workpiece is provided with a peripheral wall by the forming process, the wall having at least one axial section of high shaping and fitting accuracy. It also concerns apparatuses for carrying out the method.

BACKGROUND OF THE INVENTION

It is the practised state of the art to make pot shaped parts from a sized piece of sheet metal by deep drawing; a hollow cylindrical body may, for example, be formed, its peripheral wall having at least one axial peripheral section with high shaping and fitting accuracy. The disadvantage of this method is that tensions and tolerances in the thickness of the metal wall in the rolled material and varying tensile forces produce a hollow body which differs in shape from the tool and is, in particular, not exactly cylindrical; this is because the peripheral wall moves back resiliently after deep drawing. The production of accurately shaped and accurately fitting pot shaped hollow bodies by ironing e.g. from alloyed steel sheets is a failure because of the high deforming forces required, which cause damage to the shaped part or tools. If the hollow body is to have an axial section of high shaping and fitting accuracy at its peripheral wall, and if the now customary processes of plastic deformation are to be carried out, an additional, subsequent operation with or without cutting, such as shearing, turning or folding, is required.

SUMMARY OF THE INVENTION

The problem underlying the invention is thus to improve methods of the above type so that they can produce shaped parts, particularly from high strength sheet metal material, with high shaping and fitting accuracy, with a reduced load on the shaping tools and without any subsequent machining. The problem also includes providing at least one apparatus for carrying out one of the proposed methods.

The solution to the problem is based on a method of the above type and is further characterised in that before the peripheral wall is formed in the forming zone being created, sheet material which has been put into a plastic state by deep drawing is swaged in places round the periphery, then the swaged locations are sized by putting them into the deep drawing gap.

In a preferred embodiment of the method, in the deep drawing process in the region of the plastic forming zone of the sheet material, the axial compressive forces exerted on the sheet material differ round the periphery; thus individual swaged locations are formed before the material is pulled into the deep drawing gap, and fitting areas are created on the thus deformed sheet material, in the drawing gap of the tool at the swaged locations, at least one side of the peripheral wall of the hollow body being created. As an alternative or addition to this embodiment, while the peripheral wall is being formed as the plastic part of the sheet material enters the drawing gap, compressive stamping forces are exerted on the wall at a plurality of peripheral locations; the stamping forces act radially over axial distances on one or both sides, and the other side is pressed against a backing tool which determines the shaping and fitting accuracy of that side of the wall.

Housing-like shaped parts with a cylindrical peripheral wall can be made by this method from thicker, high strength metal sheets, particularly nickel chromium steel sheets, in a single operation by deep drawing. One or both sides of the peripheral wall have fitting areas which already have the required cylindrical shaping accuracy, and the diameters of which have the fitting accuracy required for the shaped part. The swaged and sized locations are chiefly at the free edge of the formed initial workpiece and are responsible for shaping accuracy and also for fitting accuracy, while the punched locations provide shaping and fitting accuracy and also a simple way of ensuring that the peripheral wall of the resultant shaped part has a cylindrical shape, which may extend substantially over the whole height of the wall. In many cases it is sufficient for the swaging and or stamping locations on the peripheral wall to be at a certain distance from one another, so that the fitting areas produced are also at certain intervals, even if shorter ones, on the other side of the wall. A discontinuous peripheral zone of fitting areas is formed in this way. Alternatively the swaging and/or stamping locations may be so close together that there is no space between the fitting areas of the other side of the peripheral wall, and a continuous peripheral zone of fitting areas is thus formed. This is due to the distribution of energy in the peripheral wall spreading while the forming force is acting.

Another important advantage of the method of the invention is that the deep drawing tools, or the corresponding shaping tools where non-cylindrical shaped parts are concerned, are loaded considerably less than when the drawing or shaping gap of the tools is alone responsible for shaping and fitting accuracy. The gap in question may readily be made wider, since the accuracy and cylindrical shape in question is only obtained by spot or line deformation of the peripheral wall produced. Hence the forming of thicker and stronger steel sheets is much facilitated, and can be carried out for these purposes with smaller forces on the tools.

Highly accurate housing members for the pumping steps of multi step submerged pumps of centrifugal construction can be produced inter alia in this manner. After the deep drawing process these pumps have in the past had to be made to fit accurately in respect of the diameter and circular shape, e.g. by turning the free edge of the peripheral wall of the housing. In the case of high pressure submerged pumps, where the housings are provided with an outer pipe because of the pressure and for reasons of stability, the housings for the pumping steps had to be made by casting and subsequently cut to fix them in the outer pipe and to one another. In the method of the invention housings for the pumping steps can be made accurately and far more cheaply, with economies in material and without cutting or subsequent work on them. This also applies to the bearing bushes of the pumps.

An apparatus for carrying out the method of the invention is based on an upper drawing die, a bottom drawing die with the shaping cavity and a holder to fix the initial workpiece on the bottom die. It is further characterised in that the holder and/or bottom die have radial, groove-like apertures at the sides facing one another, the apertures opening into the inner edge of the holder and/or into the shaping cavity of the bottom die, and being arranged at intervals round the inner edge and/or cavity, and that the wall surfaces of the upper die and/or shaping cavity form the sizing surfaces to create the fitting areas.

Alternatively or additionally, the apparatus may be designed so that the periphery of the upper die and/or the periphery of the cavity in the bottom die is provided at least in sections with toothing to carry out the stamping, and so that in the drawing gap the distance between the top surfaces of the toothing and the side of the wall of the cavity or die opposite them is smaller than the thickness of the work piece material.

An apparatus of this type provides an easy way of producing swaged or stamped locations with fitting areas at the desired side of the peripheral wall of the shaped part being formed. The apertures and/or toothing on the particular tool member are just a simple adaptation of conventional tools and lighten the load thereon proportionally.

BRIEF DESCRIPTION OF THE DRAWINGS

In the drawings:

FIG. 4 is a view of the holding down tool for the apparatus in FIGS. 1 to 3, seen from below, FIG. 5 is a partial axial section through a modified form of the apparatus.

DETAILED DESCRIPTION OF THE INVENTION

To facilitate explanation of the processes, the corresponding apparatuses will first be described.

Insofar as FIGS. 1 to 5; 7, 8; 13 to 17 and 20 concern the known construction, this will not be explained. Hence the only parts of the apparatus which will be drawn and described are those connected with the construction according to the invention.

Figure 1:
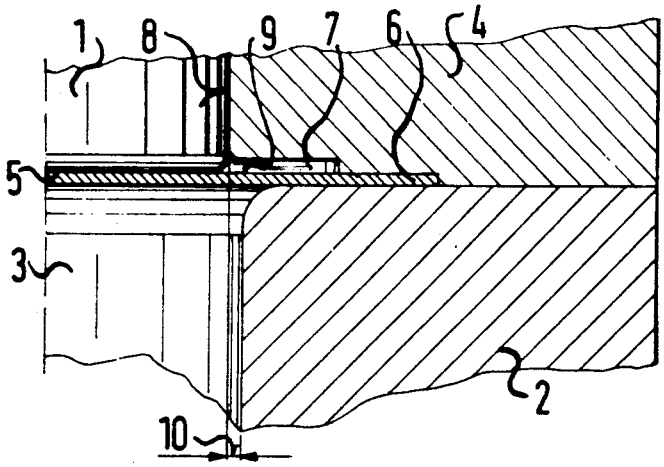
FIGS. 1 to 3 are a simplified, partial axial section through an apparatus for carrying out a proposed method in a plurality of stages.
Figure 2:
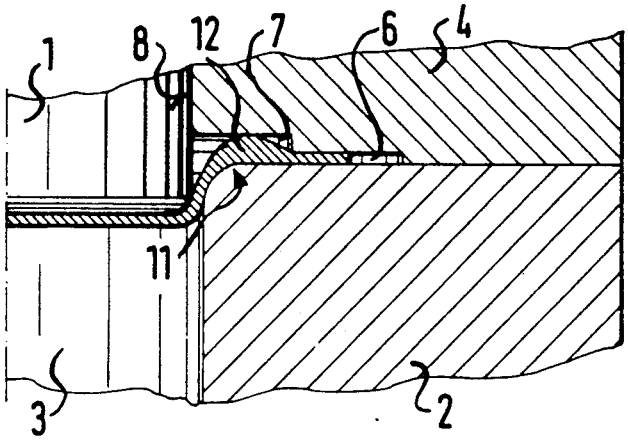
Figure 3:
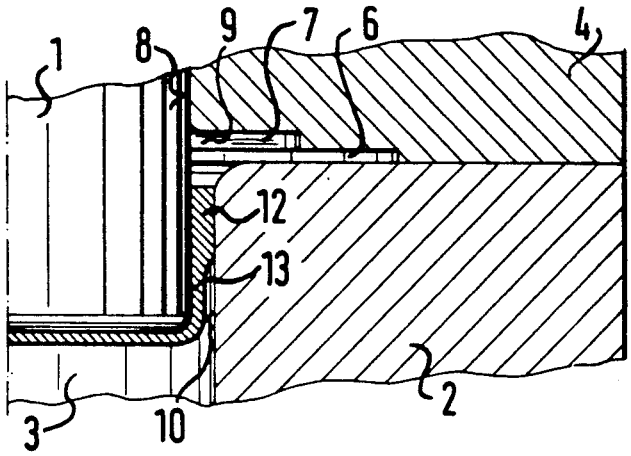

FIGS. 1, 2 and 3 show an upper drawing die 1, a bottom drawing die 2 with a shaping cavity 3 and an annular holder 4 of a deep drawing apparatus. At the side facing the initial work piece 5, which here is a circular sheet metal blank, the holder 4 contains a circular recess 6 to receive the blank (FIG. 1). The holder has a plurality of radial, groove-like apertures 7 in the region of the recess. These open into the inner edge 8 of the holder and are arranged at intervals around its inner edge, as can be seen clearly in FIG. 4. The base 9 of the apertures 7 is level, as shown in FIGS. 1, 2 and 3. When the upper die 1 enters the shaping cavity 3 of the bottom die 2, the usual drawing gap 10 forms. Its width is larger than the thickness of the blank 5, e.g. about 5 to 35% larger.

Figure 6:
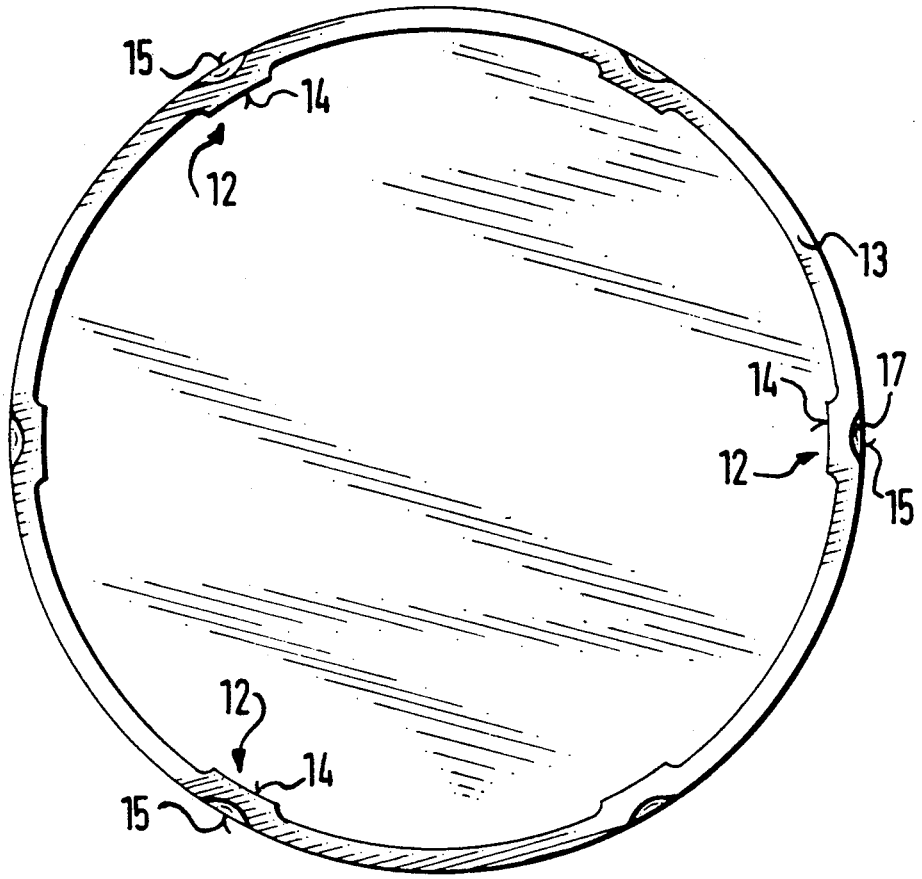
FIGS. 6 and 7 are a plan view and an axial section through a shaped part produced with the apparatus of FIGS. 1 to 3, FIGS. 8 and 9 are a front elevation and a view from below of a modified upper drawing die of the apparatus.
Figure 7:
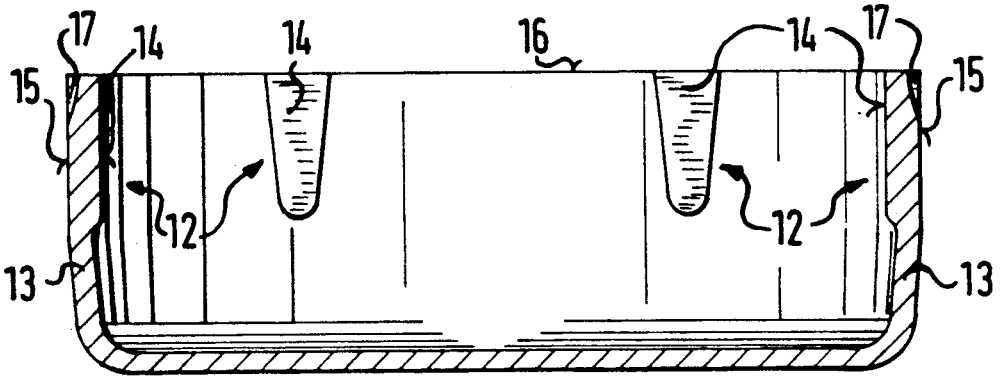

The pot shaped part shown in FIGS. 6 and 7 is produced with an apparatus of this construction. As shown in FIG. 1, the metal blank 5 contained in the recess 6 of the holder 4 is kept in a central position by the holder. The deformation of the blank begins as the upper drawing die 1 enters the shaping cavity 3 of the bottom drawing die 2. In the forming zone 11 of the blank (FIG. 2) the material goes into a normal plastic state, and the tangential compressive forces in the blank material cause plastic material to be swaged in the region of the apertures 7 in the holder and to be pressed into the apertures, as shown clearly in FIG. 2. The thickness of the resultant swaged locations 12 arranged in a circular conformation depends on the depth of the apertures. These locations are thicker than the drawing gap 10. As the upper die 1 moves further into the cavity 3, and while a pot shaped part with a peripheral wall 13 is being formed in the drawing gap, the swaged locations 12 also enter the drawing gap (FIG. 3). In this gap the locations 12 are exposed to radial compressive forces from the shaping tools, through the peripheral walls of the die 1 and of the cavity 3; consequently fitting areas 14 and 15 are formed on these sides of the swaged locations, as can be seen best from FIGS. 6 and 7. A shaped part with a peripheral wall 13 is formed in this way. On the one hand the plurality of swaged locations spread round the periphery give it an accurate "circular shape". On the other hand the inner and outer fitting areas with diameters accurate to size give the wall accurate inside and outside diameters along its axial section, which corresponds to the axial extension of the fitting areas. It should be mentioned that shaping and fitting accuracy are obtained in one operation together with the deep drawing process. Only slight machining of the free edge 16 of the peripheral wall 13 is necessary, and this can be carried out by belt grinding.

Figure 12:
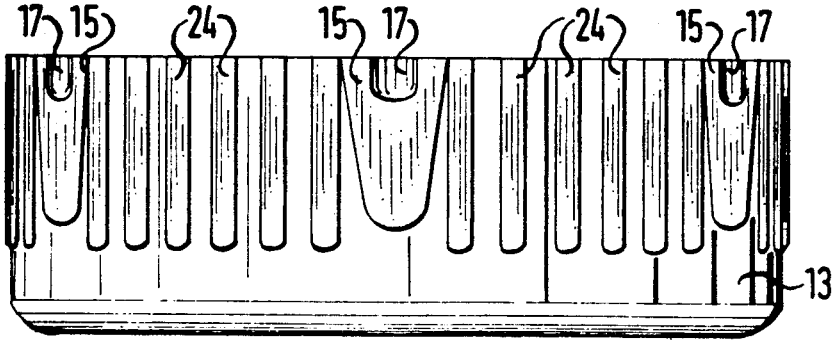

FIG. 6 shows that the outer fitting areas 15 of the swaged locations 12 contain small troughs 17. However, the troughs are only in the tops of the surfaces 15, as shown in FIGS. 7 and 12, and are very small so that they do not essentially have any adverse effect on the surfaces. They result from the tendency of the plastic sheet material to form folds in the forming zone 11, and may in some cases disappear in the belt grinding or similar process.

FIG. 5 shows a modified holder 4. The apertures 7 in the holder, which is otherwise as previously described, have a curved base 9*a*. At their radially inner end the apertures are curved to match the rounded edge of the inlet to the cavity of the bottom die 2, the curvature being opposite the inlet to the cavity. This ensures that the apertures still press on the sheet material at their radially inner end, which is not the case of the holder 4 with the apertures 7 shown in FIG. 1. The modified arrangement gives better control of the swaged locations even in the last phase of the drawing process, and the rounded edge at the cavity inlet can be made somewhat larger, thus facilitating the drawing process at that location.

The apertures 7 have been described above as being provided in the holder 4. However, they may alternatively be provided in the top of the bottom die 2. It is also possible to provide additional apertures in the bottom die, with the apertures alternating round the periphery or provided opposite one another in pairs.

Figure 17:
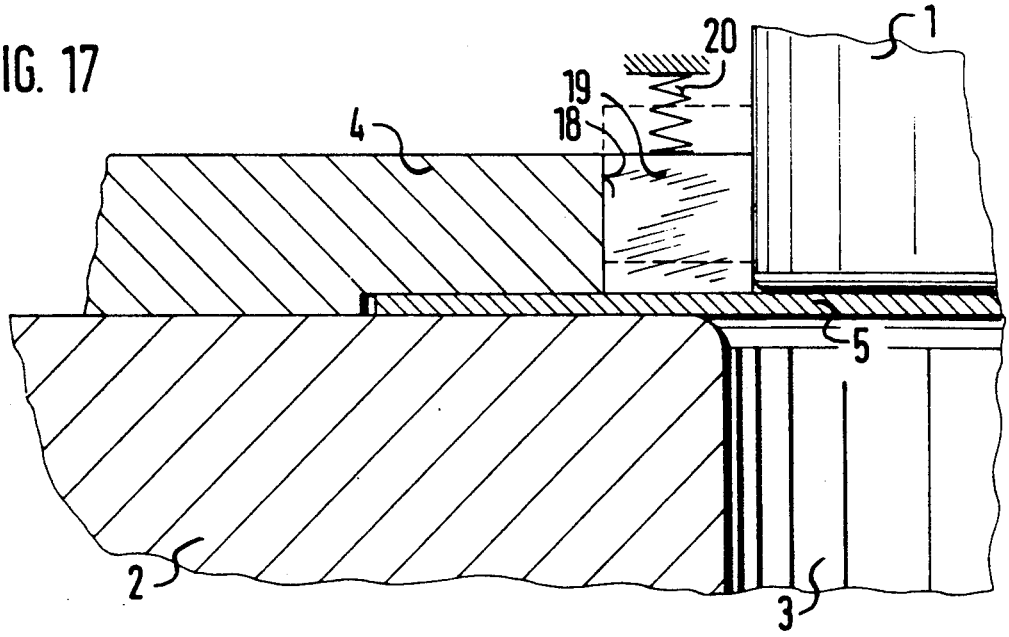

Another way of obtaining apertures to make swaged locations on the drawn sheet material is shown in FIG. 17. Instead of the apertures mentioned, the holder 4 has apertures 18 extending axially right through it. Their horizontal cross-section corresponds approximately to that of the apertures 7 in FIG. 4, and they are also distributed round the periphery of the holder. Pressure members 19 are arranged axially movably in the apertures 18 and yield to an axial force in a controlled manner, when the swaged locations are formed in the deep drawing process. The controlling restoring force of the pressure members is shown symbolically by a compression spring 20, that is to say, it may take various forms. The axial restoring force may be the same at all the pressure members 19 or different, according to whether the thickness of the swaged locations on the wall of the shaped part is required to be the same or different. When the swaged locations are formed the pressure members 19 are raised a certain distance by their force as indicated in broken lines in FIG. 17, thus forming apertures into which plastic material from the metal blank 5 is swaged.

Shaped parts as shown in FIGS. 6 and 7 can also be made with the modified apparatuses.

FIGS. 8 and 9 show a modified form of the upper drawing die 1. The periphery of the die has sections of straight toothing 21 projecting from the generated surface 2*a* of the die (FIG. 9). Between the sections of toothing 21 there are parts of the periphery (22) without any toothing, which serve to produce the inner fitting areas 14 on the swaged locations 12 of the peripheral wall 13.

Figure 10:
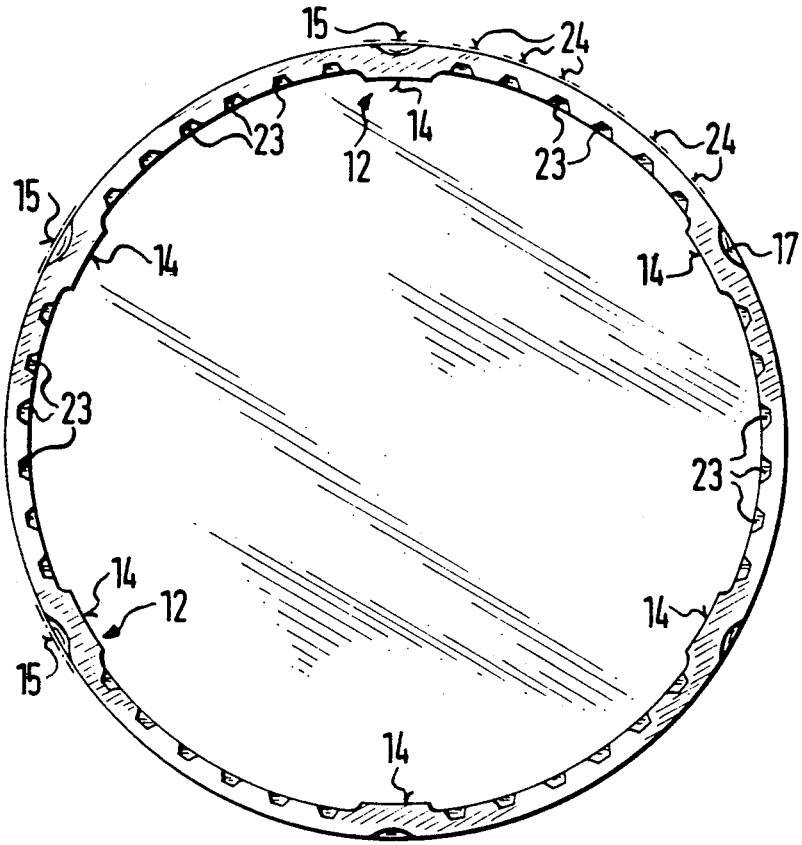
FIGS. 10, 11 and 12 show a shaped part produced with the die of FIGS. 8 and 9, in plan view, axial section and a view showing part of the outside.
Figure 11:
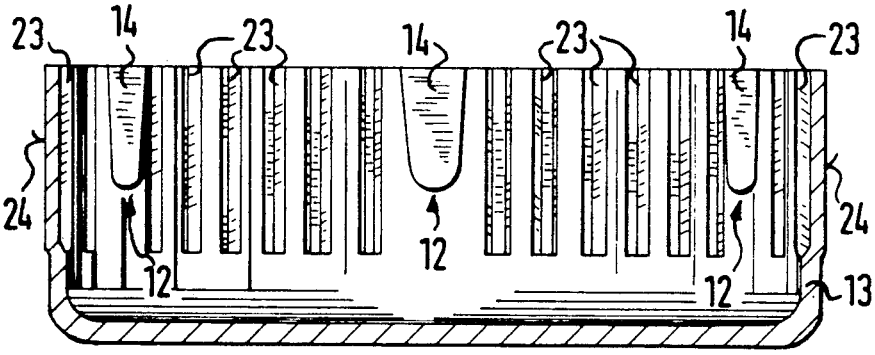

If a die of this type is used in one of the apparatuses described above, axially extending impressions 23 on the inside of the peripheral wall 13 of the shaped part are additionally formed between the swaged locations 12 with the fitting areas 14, 15, as shown clearly in FIGS. 10 and 11. The impressions again produce fitting areas 24 on the outside of the wall 13, as indicated in FIG. 12. These axial fitting areas 24 give the peripheral wall 13 a very good cylindrical shape and a very accurate diameter, to an accuracy within the hundredths of a millimetre range.

This also applies to the fitting areas 14, 15 at the swaging locations 12.

If a die shown in FIGS. 8 and 9 is used, the peripheral wall 13 formed has pairs with opposed, at least partly overlapping fitting areas 14, 15 alternating with interposed sections, preferably with a plurality of individual and external fitting areas 24. The axial length of the individual areas 24 may be greater than that of the pairs of areas 14, 15 at the swaging locations 12.

The die 1 shown in FIGS. 8 and 9 may also be constructed without the free lengths 22, so that there is then toothing 21 in those places. A peripheral wall made with such a die then has no raised swaged locations 12 with fitting areas 14, 15 but only fitting areas 24. Even walls of this type have enough shaping and fitting accuracy and cylindricity for certain applications.

Alternatively or additionally, the toothing 21 in the embodiments described may also be provided on the wall of the shaping cavity 3 of the bottom die 2.

The cross-sectional profile of the toothing 21 is shown as trapezoidal in FIG. 9. There is enough space between the individual teeth for material from the wall being formed to escape by being swaged into the gaps between the teeth, in the stamping operation carried out by the toothing 21 in the deep drawing process.

Figure 13:
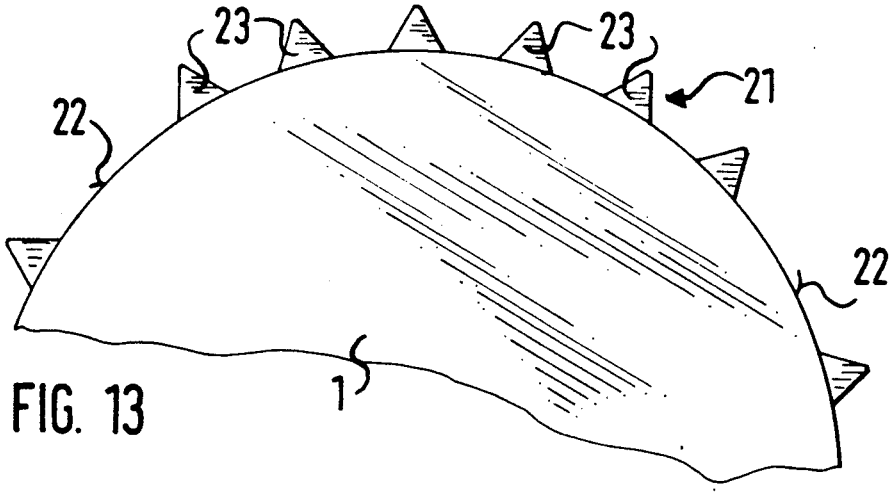
FIGS. 13, 14 and 15 are cross-sections through part of the upper drawing die of FIGS. 8 and 9 with differently shaped teeth.
Figure 14:
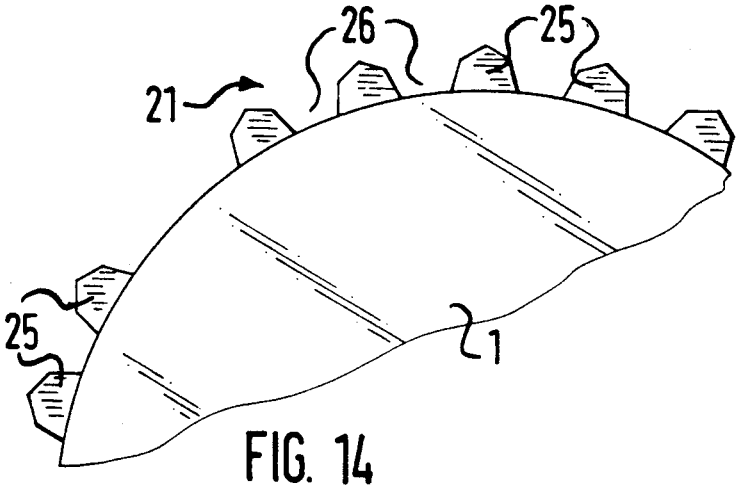
Figure 15:
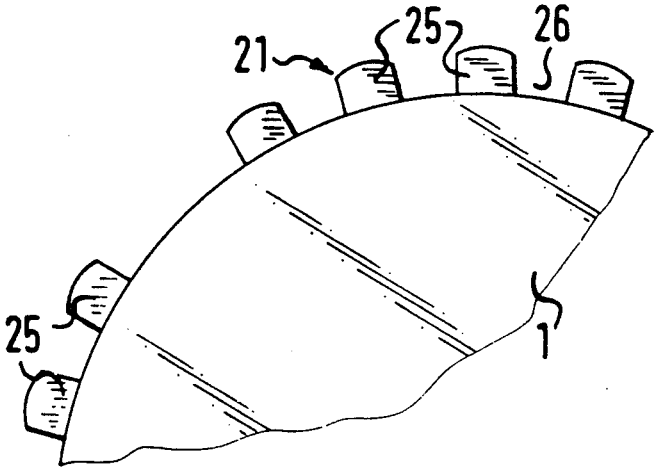

Teeth of other shapes are possible, as shown on a much larger scale in FIGS. 13, 14 and 15. Teeth 23 with a virtually acute angled cross-sectional profile are shown in FIG. 13, and here again adequate space is left between them. FIG. 14 shows teeth 24 with an obtuse angled cross-sectional profile at the top end, while the top end of the teeth 25 of the toothing 21 in FIG. 15 is rounded. Owing to their shape and predetermined spacing, the obtuse angled and rounded teeth 24 and 25 must have adequate gaps 26 available between them to receive swaged material from the peripheral wall 13 of the part to be produced. Because of the gaps 26 formed by cutting free, the sides of the teeth in question are then bent.

Figure 16:
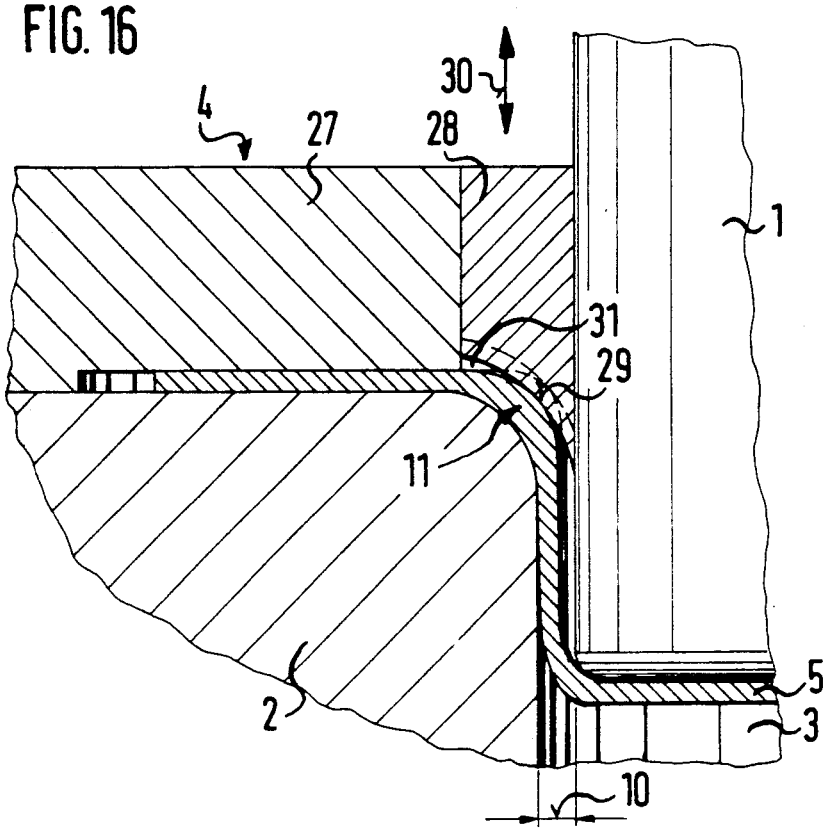
FIGS. 16 and 17 are partial axial sections through other apparatuses.

The apparatus in FIG. 16 is an alternative to FIG. 17. The holder 4 here comprises two components: an outer annular member 27 and an inner annular member 28 mounted for axial movement therein and surrounding the upper die 1 at the other side. The member 28 is substantially above the drawing gap 10. It has a curved working surface 29 which faces towards the metal blank 5 and has the same curvature as the rounded edge at the inlet of the cavity 3 of the bottom die 2. During the deep drawing process the inner member 28 is actuated with predetermined forces in the direction of the arrow 30, so that an annular gap 31 is formed at the holder 4 in the region of the forming zone 11 for the blank 5. The gap 31 is equivalent in its action to the controlled apertures 18, 19 in FIG. 17 or to the invariable apertures 7 in FIGS. 1 to 4, i.e. it allows sheet material to be swaged. If desired, a plurality of apertures distributed along the periphery of the inner member 28 may be provided in the region of the working surface 29, as indicated in broken lines.

In conjunction with the embodiments of the upper die, bottom die and holder described above, a further modification of the upper die and/or bottom die may comprise providing axial grooves 32 in the walls which give the desired shaping and fitting accuracy, as indicated in broken lines in FIG. 9, regardless of whether toothing 21 is provided. The apertures 7 in the holder 4 are then constructed so that folds are caused to form at predetermined locations in the forming zone of the metal blank 5, with the metal being swaged. The folds 33 in question are drawn into the grooves 32 by the upper die 1 when the peripheral wall 13 is formed. The peaks of the folds are pressed against the bottoms 34 of the grooves, so that fitting areas 35 are formed at the peaks.

Figure 18:
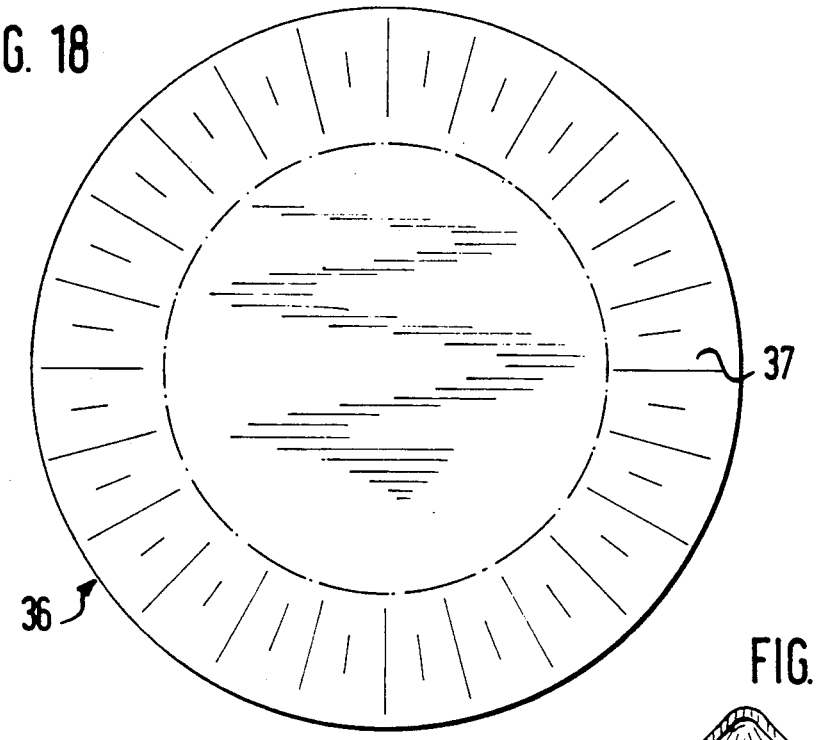
FIGS. 18, 19 and 20 show a preliminary form of the blank and an apparatus for carrying out a modified method, and, FIG. 21 shows an apparatus for carrying out yet another method.
Figure 19:
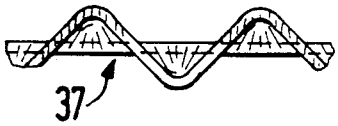
Figure 20:
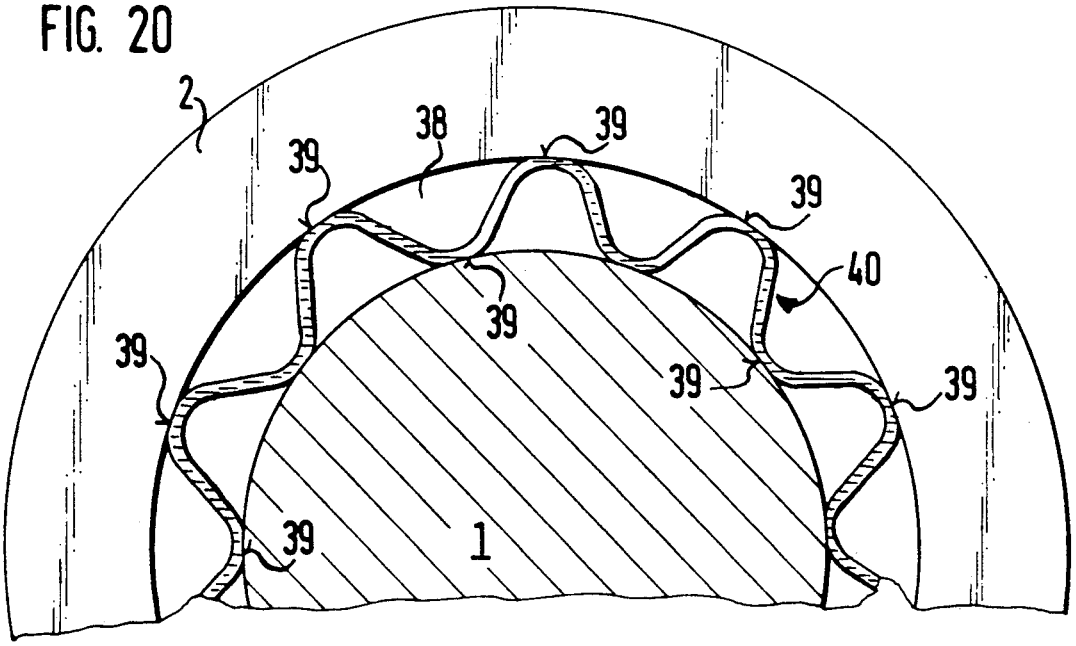

Another method of making a pot shaped part with fitting areas on its peripheral wall is illustrated in FIGS. 18, 19 and 20. FIG. 18 shows a flat circular blank 36, the outer edge 37 of which is given an undulating shape in a peripheral direction between two tools, as shown in FIG. 19. If desired, only sections of the outer edge may be shaped thus in a peripheral direction. The preformed work piece is then placed in a deep drawing apparatus and deep drawn to form a pot shaped part (FIG. 20). The width of the drawing gap 38 between the upper die 1 and the bottom die 2 is smaller than the vertical dimension between two adjacent peaks of the undulations of the outer edge 37. A fitting area 39 is accordingly formed by stamping at the peak of each undulation of the peripheral wall being formed, through the peak being pressed against the opposing axial generated surfaces of the drawing tools 1, 2, and the parts of the wall 40 between the peaks are slightly swaged. The fitting areas 39 can be seen clearly in FIG. 20.

Figure 21:
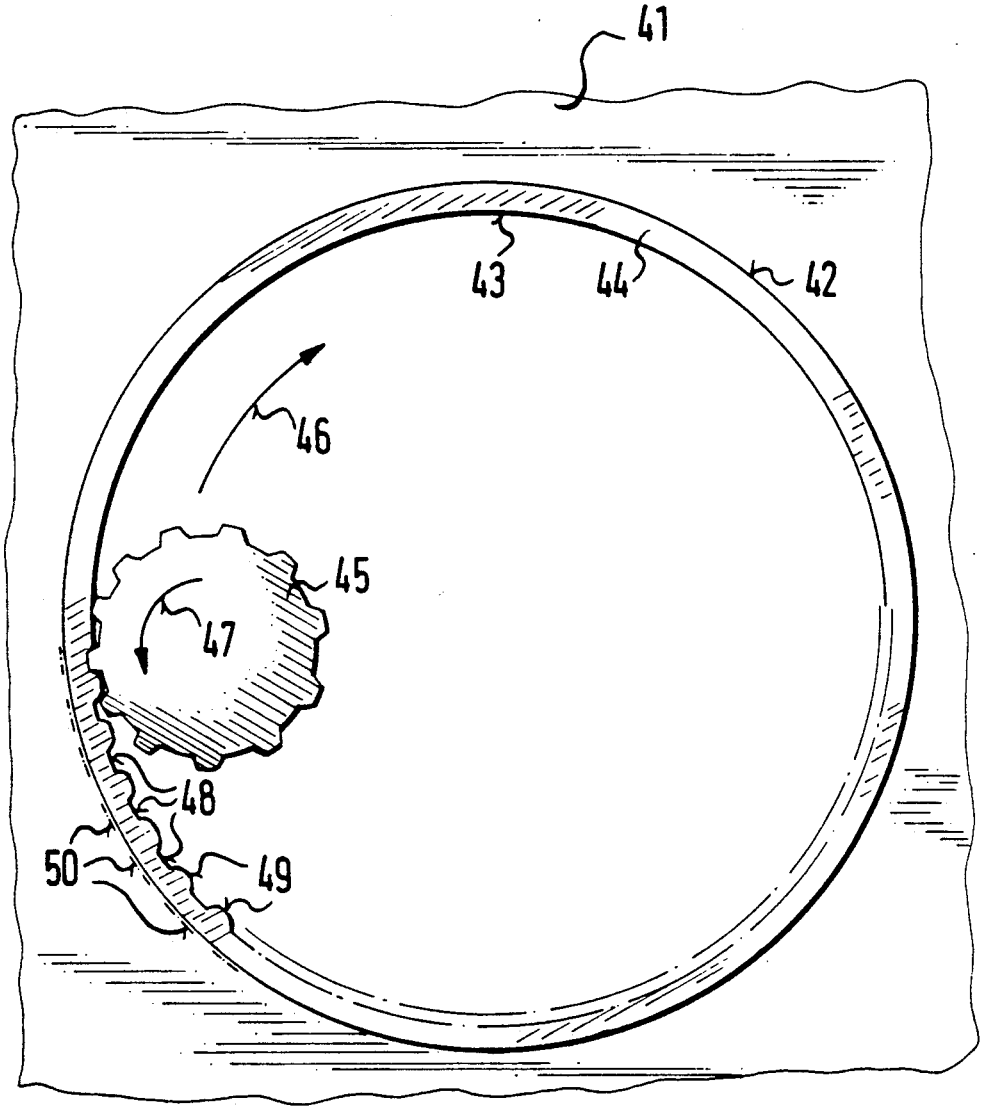

Yet another method of making a part with accurate shaping and fitting is illustrated in a side view in FIG. 21. A stationary tool 41, with a cylindrical support 42 contains a preform 43 which already has a peripheral wall 44 but no fitting areas yet. The preform may, for example, be a deep drawn shaped part, in known manner, or may be a flat metal blank shaped into a ring. A stamping tool 45 with teeth at the periphery is moved along the arrow 46 by exerting a compressive force against the inside of the wall 44, while rolling over the inside of the wall 44 in the direction of the arrow 47. Impressions 48 thereby form on the inside, with raised swaged locations 49 between them. The fitting areas 50 are consistently formed on the opposite side of the peripheral wall and are indicated symbolically by short lines.

The method may also be carried out with suitably constructed tools, with the stamping tool 45 rolling over the outside of the wall 44.

It will be clear from the above description that the fitting areas 14, 15; 24; 39 and 50 formed along the periphery at the wall in question may be at a larger or smaller spacing, so that a discontinous peripheral zone of axially extending fitting areas is provided at the peripheral wall. If the swaged and/or stamped locations in question are very close together, it may obviously happen that the fitting areas produced are no longer spaced apart, so there is a continuous peripheral zone of fitting areas.

Shaped parts of sheet metal material made by the methods and apparatus described above are particularly suitable for use in fluid flow machines, particularly pumps. In the pumping field the shaped parts are used as housing members for the pumping stages of multi-stage submerged pumps; they may be used especially in high pressure submerged pumps, where the number of pumping steps may be from 60 to 200 or far higher. Bearing bushes may be produced in this way, particularly for pumps, and in the case of a pot shaped component the bottom of the pot may be removed. A further advantage of the shaped parts mentioned is that they can be made from nickel chromium steel sheet without cutting, by the forming method, and the thickness of the starting material may be relatively great, e.g. 1.5 to 4.0 mm.

Although in the above explanation the proposed method and apparatus features are largely directed to deep drawing, the features proposed are not restricted to this. This is clear even from the method described in connection with FIG. 21. The above explanation deals substantially with a cylindrical peripheral wall. However, tapering peripheral walls may e.g. be made, with the swaged locations in question which have fitting areas, and/or with stamping locations which also lead to fitting areas. The corresponding forming tools then again contain apertures for forming swaged locations, and/or have stamping tools. In either case the desired fitting areas are formed to give the peripheral wall in question the required shaping and/or fitting accuracy.

What is claimed is:

1. A method of making a pot-shaped object from an initial blank of high strength sheet metal having a circular periphery and a thickness in the range of 1.5 to 4.0 mm, the method comprising the steps of:

deep drawing the sheet metal blank into a plastic state in a circular forming zone of the initial blank;

upsetting the sheet metal blank at locations around the periphery of the blank within said forming zone to build up thickened portions therein; and deep drawing the thickened portions together with the other and thinner plastic state material of the sheet metal into a deep drawing gap, whereby a peripheral wall is formed with thickened locations in respect of the remaining wall being formed, which locations are spaced apart from each other around said wall and the inner and outer faces of which form first fitting faces and together define two cylindrical forms with inner and outer diameters and shapes of high accuracy of the produced wall, wherein while said other plastic state material of the sheet metal is entering the drawing gap, additional compressive stamping forces, acting radially along said axial section, are additionally exerted at a plurality of peripheral locations between said first locations on one side of the peripheral wall being formed to further produce second fitting areas on the opposite side of the peripheral wall which together define an identical cylindrical form of one of the foresaid cylindrical forms.

2. A method as claimed in claim 1, wherein compressive stamping forces differing in extent are exerted on the initial blank at the upsetting locations in the region of the plastic forming zone to form thickened portions of different thickness.

3. A method according to claim 1, for making accurate housing members for the pumping steps of multistep submerged pumps of centrifugal construction.

4. Apparatus for forming a pot-shaped object from an initial blank of high strength sheet metal of a thickness in the range of 1.5 to 4.0 mm, the apparatus comprising:

an upper drawing die having non-profiled wall surfaces;

a bottom drawing die having a shaping cavity which the upper die enters during the deep drawing operation to form a drawing gap having a width which is 5 to 35% larger than the thickness of the blank;

a holder to fix the initial blank on the bottom die;

radial, groove-like apertures provided in at least one of the holder and the bottom die on a side thereof facing the workpiece, the apertures opening into an inner edge of the holder when provided in the holder and into the shaping cavity when provided in the bottom die, said apertures being arranged opposite to said non-profiled wall surfaces;

a first group of axially extending pairs of pressure faces formed by the non-profiled wall surfaces of the upper die and of zones of the shaping cavity of the bottom die, which zones lie opposite to said non-profiled surfaces when the upper die moves into said cavity, which zones and surfaces forming inner and outer fitting faces on the peripheral wall of the pot-shaped object lying opposite to each other;

a second group of axially extending pairs of pressure faces formed by the top surfaces of a toothing projecting from sections around the periphery of at least one of the upper die and the shaping cavity of the bottom die and by backing faces provided on at least one of the upper die and the shaping cavity of the bottom die and at locations opposite to said top surfaces of the toothing, said backing faces forming fitting faces on the peripheral wall of the pot-shaped object which lie on the same circle of one of that of said inner and outer fitting faces;

the first and second groups of pairs of pressure faces are arranged alternately in the peripheral direction of the upper die and the shaping cavity of the bottom die.

5. Apparatus as claimed in claim 4, wherein the holder has an outer member and an inner annular member which is arranged coaxially and movable axially therein, the inner member comprising said apertures and being above the drawing gap and a working area of the inner member being curved to match a rounded edge at the inlet of the shaping cavity of the bottom die.

6. Apparatus as claimed in claim 4, wherein the base of the groove-like apertures is curved at its radially inner end, so as to match a rounded edge at the inlet of the shaping cavity of the bottom die.

7. Apparatus as claimed in claim 4, further comprising a plurality of pressure members provided circumferentially on at least one of a part of the holder opposite a circular plastic forming zone of the initial blank and a part of the die opposite said forming zone, said pressure members yielding axially in apertures spread around the periphery for controlled upsetting of the initial blank in its plastic forming zone.

8. Apparatus as claimed in claim 7, wherein the working face of the pressure members is curved at its radially inner end, so as to match a rounded edge at the inlet of the shaping cavity of the bottom die.

9. Apparatus according to claim 4, wherein said pot-shaped object comprises a highly accurate housing member for the pumping steps of multi-step submerged pumps of centrifugal construction.

* * * * *